US005175469A

United States Patent [19]

Droho

[11] Patent Number: 5,175,469

[45] Date of Patent: Dec. 29, 1992

[54] COMBINATION INCLUDING AN EMERGENCY LIGHTING ARRANGEMENT

[75] Inventor: Joseph S. Droho, Chicago, Ill.

[73] Assignee: North American Philips Corporation, New York, N.Y.

[21] Appl. No.: 703,543

[22] Filed: May 21, 1991

[51] Int. Cl.[5] ..... H05B 41/00

[52] U.S. Cl. ..... 315/92; 315/88; 315/247

[58] Field of Search ..... 315/88, 92, 46, 47, 315/313, 247

[56] References Cited

U.S. PATENT DOCUMENTS 4,005,331 1/1977 Horowitz ..... 315/92
4,047,076 9/1977 McNamara ..... 315/88
4,099,095 7/1978 Turner ..... 315/92
4,560,906 12/1985 Kerekes ..... 315/47

FOREIGN PATENT DOCUMENTS 2425720 4/1976 Fed. Rep. of Germany ..... 315/247
444305 9/1967 Switzerland .

*Primary Examiner*—Robert J. Pascal
*Attorney, Agent, or Firm*—Edward Blocker

[57] ABSTRACT

An arrangement for use with gaseous discharge lamp circuits having a power factor capacitor in which the capacitor can be disconnected from the circuit when the lamp is not drawing current and in which an emergency lamp can be connected across a voltage source when the discharge lamp is not drawing current.

12 Claims, 1 Drawing Sheet

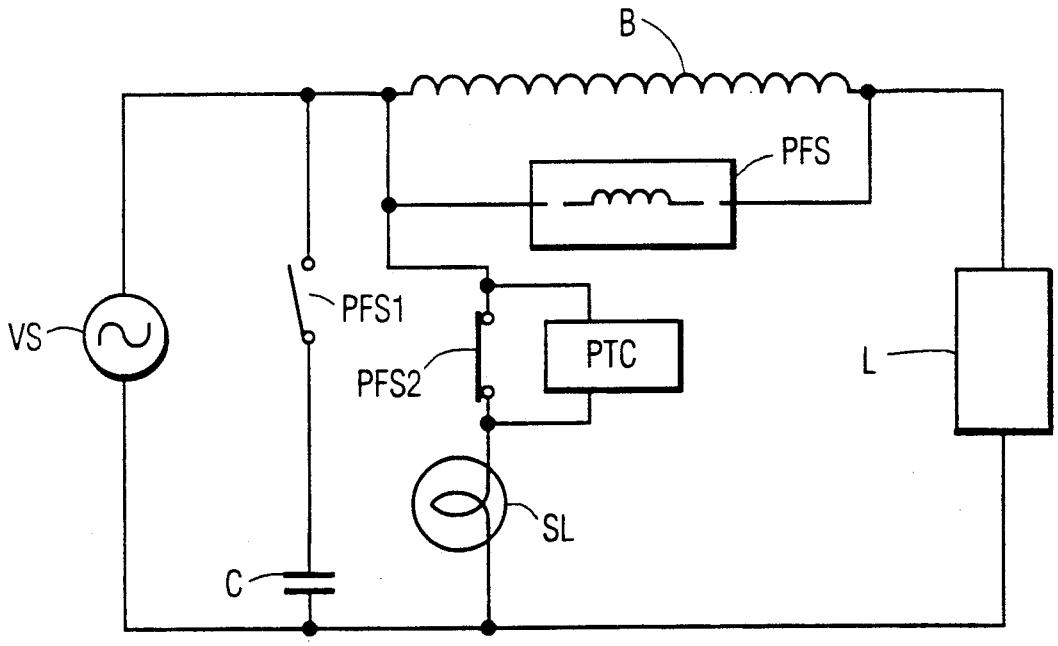
B
PFS
PFS1
VS
PTC
PFS2
L
SL
C

COMBINATION INCLUDING AN EMERGENCY LIGHTING ARRANGEMENT

BACKGROUND OF THE INVENTION

This is an invention in the lighting art. More particularly, it involves a combination of a standby lighting arrangement with a means for disconnecting a power factor capacitor.

This application is related to Application Ser. No. 619,855 entitled "BALLAST CIRCUIT WITH MEANS TO DISCONNECT POWER FACTOR CAPACITOR" filed on Nov. 29, 1990 in the name Joseph S. Droho, now U.S. Pat. No. 5,072,156 (Dec. 10, 1991), and assigned to the assignee of this application. U.S. Pat. No. 5,072,156 is incorporated by reference herein. In that application, a sensor was connected across the ballast means for a discharge lamp. The sensor operated so as to prevent a power factor capacitor from being present in the circuit during the startup period for the discharge lamp. In that way, that arrangement provided improved operation of gaseous discharge lamps with power factor correction.

SUMMARY OF THE INVENTION

It is an object of this invention to provide emergency lighting in an area where a discharge lamp should be functioning but is not.

One of the features of the invention is that it employs the same sensor, which is used to prevent a power factor capacitor from being in circuit with a discharge lamp during startup, to provide voltage to an emergency lamp. In this way, should a discharge lamp in a particular area not be functioning because it is broken or has been removed from its socket, the area is still illuminated.

One of the advantages of the invention is that it may be used in discharge lamp arrangements which either have power factor capacitive correction or do not have power factor capacitive correction.

In accordance with one aspect of the invention, there is provided a gaseous discharge lamp system including a source of voltage and a gaseous discharge lamp for connection to the source of voltage. A ballast means is connected in series with the gaseous discharge lamp and a power factor capacitor is connectable across the source of voltage. There is also provided a second lamp for connection across the source of voltage. Also included is a sensing means which senses that current is flowing in the gaseous discharge lamp when it is connected to the source of voltage. The sensing means in response to current flowing through the lamp connects the power factor capacitor across the source of voltage and disconnects the second lamp from the source of voltage. The sensing means operates when no current is flowing in the lamp to disconnect the power factor capacitor from the source of voltage and to connect the second lamp thereto.

In accordance with another aspect of the invention, there is provided a gaseous discharge lamp system including a source of voltage and a gaseous discharge lamp for connection to the source of voltage. A ballast means is connected in series with the gaseous discharge lamp and a second lamp is connectable across said source of voltage. Also included is a sensing means which senses that current is flowing in the gaseous discharge lamp when it is connected to the source of voltage. The sensing means operates in response to current flowing in said gaseous discharge lamp to disconnect the second lamp from the source of voltage. The sensing means operates when no current is flowing in the gaseous discharge lamp to connect the second lamp to the source of voltage.

BRIEF DESCRIPTION OF THE DRAWINGS

Other objects, features and advantages of the invention will be apparent from the following description and appended claims when considered in conjunction with the accompanying drawing in which:

the sole FIGURE of the drawing is a schematic wiring diagram of an embodiment of the invention.

DESCRIPTION OF THE PREFERRED EMBODIMENTS

Referring to the drawing, there is shown therein a lamp L connected in series with a ballast means B in the form of a reactor ballast and a voltage source VS. Coil PFS of a power factor switch is connected in parallel with reactor ballast B. Normally open contacts PFS1 of the power factor switch are connected in series with a power factor correction capacitor C. Both of these elements are connected in series across voltage source VS.

Also connected across voltage source VS are normally closed contacts PFS2 of the power factor switch in series with a second lamp SL. Connected in parallel with contacts PFS2 of the power factor switch is a positive temperature coefficient resistor PTC.

In operation should all elements shown in the drawing be in circuit with each other, lamp L will light in response to the voltage across it and reactor ballast B from voltage source VS. With current flowing through lamp L, a voltage drop is produced across reactor ballast B which is sensed by coil PFS of the power factor switch. Upon sensing such voltage, the power factor switch closes its contacts PFS1 which connect power factor correcting capacitor C in the circuit to improve the power factor of the circuit. In addition, normally closed contacts PFS2 will open to disconnect the second lamp SL from the parallel connection across voltage source VS contacts PFS2 provide. The positive temperature coefficient resistor PTS continues the connection of the second lamp SL across voltage source VS for a short period to provide emergency lighting while lamp L is turning on.

If lamp L should cease to draw current from voltage source VS for whatever reason, the voltage drop across ballast means B will cease and coil PFS of the power factor switch will no longer be energized. As a result, contacts PFS1 of the power factor switch will open and remove power factor correcting capacitor C from the circuit so that it will no longer draw current from voltage source VS. At the same time, contacts PFS2 will close to connect the second lamp SL across voltage source VS in order to provide emergency lighting in the area of lamp L.

As anyone skilled in the art will understand, the power factor switch with its coil PFS and its normally closed contacts PFS2 can be provided with a second lamp SL without the power factor correcting capacitor C and normally opened contacts PFS1.

It should be apparent that various modifications of the above invention will be evident to those skilled in the art and that what is disclosed herein is for illustrative purposes and is not to be considered restrictive.

What is claimed is:

1. A gaseous discharge lamp system comprising: a pair of input terminals for a source of voltage, a gaseous discharge lamp for connection to said source of voltage, a ballast means connected in series with said gaseous discharge lamp to said pair of input terminals, a second lamp for connection across said source of voltage, and sensing means connected in parallel with the ballast means for sensing that current is flowing in said gaseous discharge lamp when said gaseous discharge lamp is connected to said source of voltage, said sensing means operating in response to a voltage induced in the ballast means when said current flows thereby to disconnect said second lamp from said source of voltage, said sensing means operating when no current is flowing in said gaseous discharge lamp to connect said second lamp to said source of voltage.

2. A gaseous discharge lamp system as in claim 1, wherein said sensing means includes a switch comprising a coil connected in parallel with said ballast means and a pair of normally closed contacts connected in series with said second lamp to said input terminals.

3. A gaseous discharge lamp system as in claim 2, further comprising a positive temperature coefficient resistor connected in parallel with said normally closed contacts and in series with said second lamp.

4. A gaseous discharge lamp system according to claim 2, further comprising a power factor capacitor, wherein said ballast means is a reactor ballast and said switch includes a pair of normally open contacts connected in series with the power factor capacitor to the input terminals whereby said coil operates both pairs of contacts in synchronism.

5. A gaseous discharge lamp system according to claim 4, further comprising a positive temperature coefficient resistor connected in parallel with said normally closed contacts and in series with the second lamp.

6. A gaseous discharge lamp system comprising: a pair of input terminals for connection to a source of voltage, a gaseous discharge lamp for connection to said source of voltage, a ballast means connected in series with said gaseous discharge lamp to said pair of input terminals, a power factor capacitor for connection across said source of voltage, a second lamp for connection across said source of voltage, and sensing means for sensing a current flow in said gaseous discharge lamp when connected to said source of voltage and in response thereto connecting said power factor capacitor across said source of voltage and disconnecting said second lamp from said source of voltage, said sensing means operating when no current is flowing in said lamp to disconnect said power factor capacitor from said source of voltage and to connect said second lamp thereto.

7. A gaseous discharge lamp system as in claim 6, wherein said sensing means comprises a switch device including a coil connected in parallel with said ballast means and a pair of normally closed contacts connected in series with said second lamp to said input terminals.

8. A gaseous discharge lamp system as in claim 7, further comprising a positive temperature coefficient resistor connected in parallel with said normally closed contacts and in series with the second lamp and operative to provide a time delay in turning off the second lamp upon re-ignition of the discharge lamp.

9. A gaseous discharge lamp system according to claim 7, wherein said ballast means is a reactor ballast.

10. A gaseous discharge lamp system according to claim 9, further comprising a positive temperature coefficient resistor connected in parallel with said normally closed contacts.

11. A gaseous discharge lamp system comprising:

a pair of input terminals for connection to a source of AC voltage, a ballast means connected in series circuit with a gaseous discharge lamp to said pair of input terminals, a switch device comprising an actuating coil connected across the ballast means and a pair of normally closed contacts and a pair of normally open contacts operated in synchronism by the actuating coil, a second lamp for connection to said pair of input terminals, a power factor capacitor for connection to said pair of input terminals, first means connecting said second lamp and said pair of normally closed contacts in a second series circuit to said pair of input terminals, second means connecting said power factor capacitor and said pair of normally open contacts in a third series circuit to said pair of input terminals, and wherein said actuating coil is responsive to a voltage induced in the ballast means when a current flows in the discharge lamp to close the normally open contacts and thereby connect the power factor capacitor to said pair of input terminals and to open said normally closed contacts to disconnect the second lamp from said pair of input terminals, said actuating coil being operative when no lamp current flows in the ballast means to open the normally open contacts to disconnect the power factor capacitor from the pair of input terminals and to close the normally closed contacts to connect the second lamp to the pair of input terminals.

12. A gaseous discharge lamp system as claimed in clam 11 further comprising a PTC resistor connected in parallel with the normally closed contacts and in series with the second lamp thereby to provide a time delay in turning off the second lamp upon re-ignition of the discharge lamp.

* * * * *